US007203447B2

(12) United States Patent
Koshida

(10) Patent No.: US 7,203,447 B2
(45) Date of Patent: Apr. 10, 2007

(54) IMAGE FORMING APPARATUS WITH FIRST AND SECOND OPENABLE PORTIONS

(75) Inventor: Kohei Koshida, Ibaraki-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/600,704

(22) Filed: Jun. 23, 2003

(65) Prior Publication Data

US 2003/0235430 A1 Dec. 25, 2003

(30) Foreign Application Priority Data

Jun. 24, 2002 (JP) ..... 2002-182838

(51) Int. Cl.
*G03G 15/00* (2006.01)
*G03G 15/20* (2006.01)

(52) U.S. Cl. ..... 399/124; 399/110; 399/125

(58) Field of Classification Search ..... 399/124, 399/125, 110–112; 347/138, 152
See application file for complete search history.

(56) References Cited

U.S. PATENT DOCUMENTS 5,140,369 A * 8/1992 Haneda et al. ..... 399/112
5,517,281 A * 5/1996 Miyashiro et al. ..... 399/124
5,587,769 A * 12/1996 Sawada et al. ..... 399/110
5,742,319 A * 4/1998 Fukunaga et al. ..... 347/138
5,974,289 A 10/1999 Yamaguchi
6,397,016 B1 * 5/2002 Katakabe et al. ..... 399/112

FOREIGN PATENT DOCUMENTS

| | | | |
|---|---|---|---|
| JP | 3-84837 | | 8/1991 |
| JP | 03271754 | A * | 12/1991 |
| JP | 07181815 | A * | 7/1995 |
| JP | 07325444 | A * | 12/1995 |
| JP | 10-187002 | | 7/1998 |
| JP | 10-307439 | | 11/1998 |
| JP | 11-133694 | | 5/1999 |
| JP | 2001209229 | A * | 8/2001 |
| JP | 2002-6583 | | 1/2002 |

OTHER PUBLICATIONS

Translation of Haneda et al., JP 03-084837 U, Aug. 28, 1991.*

* cited by examiner

*Primary Examiner*—David M. Gray
*Assistant Examiner*—Ryan Gleitz
(74) *Attorney, Agent, or Firm*—Fitzpatrick, Cella, Harper & Scinto

(57) ABSTRACT

The present invention relates to an image forming apparatus comprising an image carrier for carrying an image, an intermediate transfer body to which the image on the image carrier is transferred, a transfer material conveying unit for conveying a transfer material along a conveyance route, a transfer unit for transferring the image on the intermediate transfer body onto the transfer material conveyed by the transfer material conveying unit, a delivery portion for delivering the transfer material, a first openable portion, openable with respect to an apparatus body, for holding the intermediate transfer body and the delivery portion, and a second openable portion openable to expose the conveyance route. The first and second openable portions are opened and closed independently from each other.

9 Claims, 7 Drawing Sheets

IMAGE FORMING APPARATUS WITH FIRST AND SECOND OPENABLE PORTIONS

BACKGROUND OF THE INVENTION

1. Field of the Invention

This invention relates to a layout structure for electrophotographic photocopiers, printers, recording apparatuses, and the like.

2. Description of Related Art

Multicolor image forming apparatuses using an electrophotographic method tend to require an increased number of developing units and complicated processes, such as development and transfer in overlapping the respective colors, and fixture of multi-layer toners, in comparison with conventional monochrome engines. Those apparatuses are further subject, with high frequency, to replacement of electrostatic latent image forming bodies, such as color developers and photosensitive bodies, and a jamming recovery operation for the engine is also needed. Therefore, an engine structure excellent in maintenance and jamming recovery property is demanded.

FIG. 6 shows a perspective view of a conventional example. A primary charger, a developing unit, and a transfer charger (all not shown) are disposed around each photosensitive drum, and form respective units as process cartridges 1*a* to 1*d*. Numeral 5 denotes a fixing unit; numeral 4 denotes a feeding cassette; numeral 3 denotes a secondary transfer roller; numeral 2 denotes an intermediate transfer belt (intermediate transfer body); and numeral 7 denotes a delivery tray.

During maintenance of the process cartridges 1*a* to 1*d*, a side door 10 is opened to allow the process cartridges 1*a* to 1*d* to be pulled out. As shown in FIG. 7, the intermediate transfer belt 2 is then moved in a direction of arrow X to release pressure between the intermediate transfer belt 2 and the photosensitive drums 20*a* to 20*d* of the process cartridges 1*a* to 1*d*.

The process cartridges 1*a* to 1*d* are made to slide in a direction of arrow Y as shown in FIG. 6, and new process cartridges 1*a* to 1*d* are inserted. When a transfer material is jammed in a conveyance route 25, a front door 11 is openable in a front and back direction at the conveyance route 25 to allow jamming treatment.

In Japanese Patent Application Publication JP-A-11-133,694, to improve jamming recovery and controllability, a mechanism in which the transfer portion is openable forwardly around an apparatus lower portion as a center, and a mechanism in which the photosensitive body belt portion is lifted upward around an apparatus rear portion as a center are provided, thereby allowing maintenance work and paper jamming recovery.

With the multicolor image forming apparatus as shown in FIGS. 6 and 7, however, the accessing directions for replacement of the process cartridges and paper jamming recovery are on the apparatus front and side, so that there is a problem that a larger working space is necessary. It is disadvantageous that the apparatus side space is required during pulling out and inserting of the process cartridges. Furthermore, the apparatus tends to be larger and more complicated due to a moving mechanism of the intermediate transfer belt for releasing pressure between the intermediate transfer belt and the photosensitive drum of the process cartridge during replacement of the process cartridge, thereby increasing the cost of the apparatus.

Because a sliding mechanism for pulling out and inserting the process cartridges is inevitably provided, the apparatus tends to be larger and more complicated. In the publication JP-A-11-133,694, when the operator conducts the maintenance work for the photosensitive bodies or the like while standing at a front side, the apparatus is structured as not to open the photosensitive belt unit upward unless the transfer unit is made open toward the front side about a pivot at the apparatus lower portion, and therefore, there arises problems such that not only the transfer portion opened toward the front side may become disturbed, but also the operator cannot easily access the developing unit or the like when two opening operations are needed. Moreover, other conventional designs relating to the opening and closing operation of the apparatuses are exemplified in Japanese Patent Application Publications JP-A-10-307,439 and JP-A-2002-6583.

SUMMARY OF THE INVENTION

It is an object, in consideration for solving the above problems, to provide an image forming apparatus with improved controllability including jamming recovery and apparatus maintenance property and with a simplified structure.

A preferable image forming apparatus according to the invention to accomplish the above object includes: an image carrier for carrying an image; an intermediate transfer body to which the image on the image carrier is transferred; transfer material conveying means for conveying a transfer material along a conveyance route; transfer means for transferring the image on the intermediate transfer body onto the transfer material conveyed by the transfer material conveying means; a delivery portion for delivering the transfer material on which the image is transferred; a first openable portion, openable with respect to an apparatus body, for holding the intermediate transfer body and the delivery portion; and a second openable portion openable to expose the conveyance route, wherein the first and second openable portions are opened and closed independently of each other.

DETAILED DESCRIPTION OF THE PREFERRED EMBODIMENTS

Figure 1:
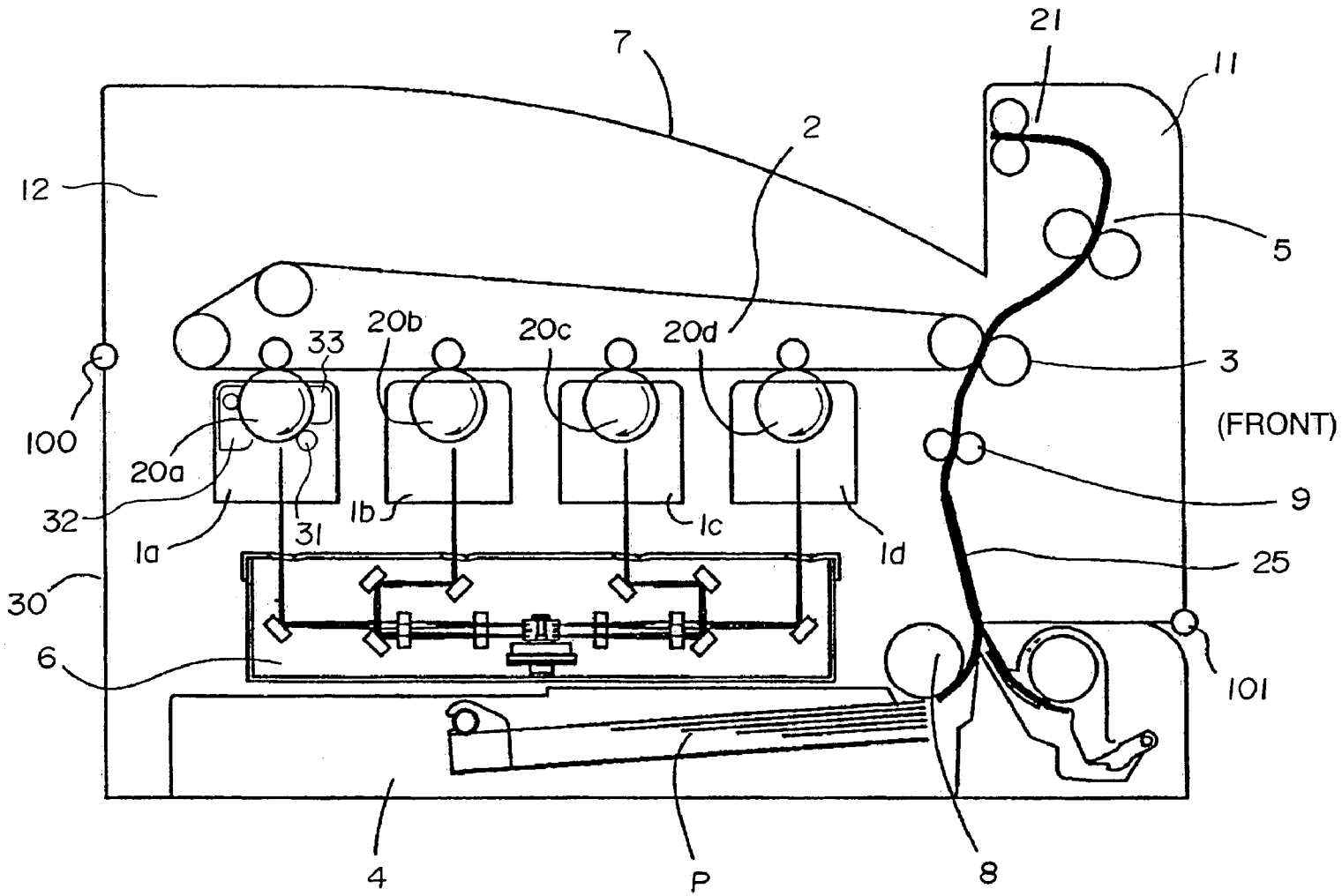
FIG. 1 is a cross-section showing an image forming apparatus.

Hereinafter, embodiments of the invention are described in referring to the drawings. First, based on FIG. 1, an image forming process is described. A printer serving as an image forming apparatus includes four photosensitive drums 20*a* (yellow), 20*b* (magenta), 20*c* (cyan), 20*d* (black) serving as image carriers disposed parallel for forming toner images in respective colors of yellow, magenta, cyan, and black, and an intermediate transfer belt 2 disposed above those photosensitive drums 20*a* to 20*d* in such a manner to downwardly contact those drums. The photosensitive drums and the intermediate transfer belt rotate in a direction of the arrows shown in FIG. 1.

A charger 31, a developer 32, and a cleaner 33 are disposed around the photosensitive drum 20*a*, and are integrated as a process cartridge (image forming unit) 1*a*. The other photosensitive drums 20*b* to 20*d* also have substantially the same structure as the photosensitive drum 20*a* and form the process cartridges 1*b* to 1*d*, respectively. The photosensitive drums 20*a* to 20*d* are charged by the respective chargers, and latent images for yellow, magenta, cyan, and black are formed on the photosensitive drums 20*a* to 20*d* upon exposure of color-resolved photo images in respective colors, yellow, magenta, cyan, and black, with an exposing apparatus 6. The respective latent images are developed with the developers to form toner images in yellow, magenta, cyan, and black on the photosensitive drums 20*a* to 20*d*, thereby being transferred onto the intermediate transfer belt 2 sequentially.

A transfer material P is contained in a feeding cassette 4. The feeding cassette 4 has a structure that can be pulled out through a front side, and for example, supply of the transfer material P and recovery of paper jamming can be effected by pulling the feeding cassette 4 through the front side of the apparatus. Each sheet of transfer material P is fed out one by one by a pickup roller (feeding conveying means) 8 from the feeding cassette 4, and is conveyed to a nipping portion formed by a secondary transfer roller 3 and the intermediate transfer belt 2 after matching the timing by means of a register roller 9, to thereby secondarily transfer the toner image on the intermediate transfer belt 2.

The transfer material P on which the toner images are secondarily transferred is then conveyed to a fixing unit 5, where fixing is effected by applying heat and pressure. Fixing melts the toners in respective colors and brings mixed colors to form a full color printed image immobilized on the transfer material P, and then, the transfer material P is delivered to a delivery tray 7 by a delivery conveying means 21 disposed on a downstream side of the fixing unit 5.

Next, an apparatus structure is described. In the color image forming apparatus shown in FIG. 1, the feeding cassette 4 is disposed on the lowest portion of apparatus body 30. The process cartridges 1*a* to 1*d* for performing image formation are arranged sequentially below the intermediate transfer belt 2 at the apparatus body 30, and an exposing apparatus 6 is disposed below the process cartridges 1*a* to 1*d*.

Figure 2:
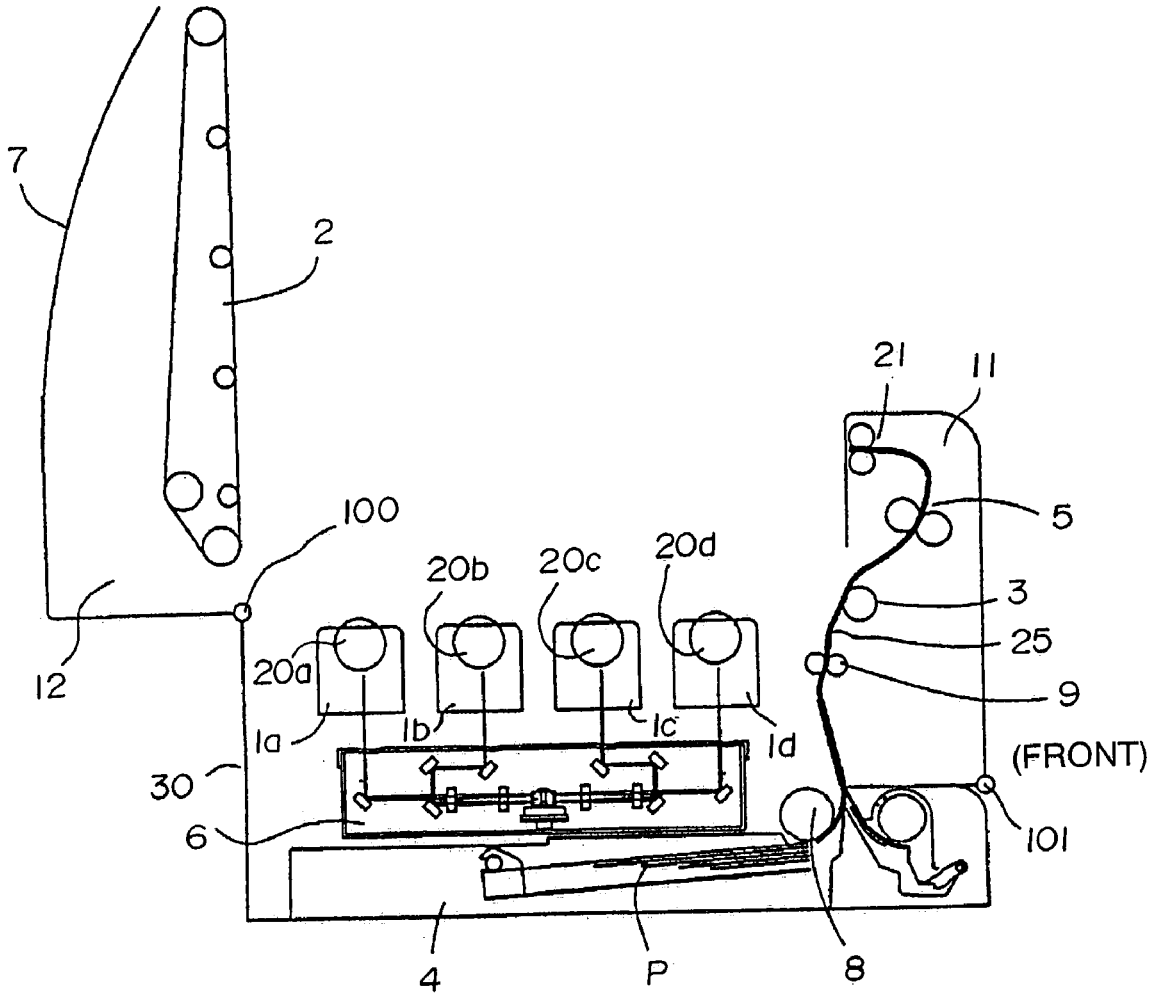
FIG. 2 is a cross-section showing a first openable portion in an opened state.

The delivery tray 7 is disposed above the intermediate transfer belt 2. The intermediate transfer belt 2 and the delivery tray 7 are integrated in a same housing (top opening mechanism, first openable portion) 12, and are openable around a shaft 100 as a center with respect to the apparatus body 30 as shown in FIG. 2. The fixing unit 5 is disposed above the secondary transfer roller 3 at a location not interfering with the housing 12 during opening and closing. A conveyance route 25 of the transfer material is arranged on a front side of the apparatus body, and defines a route from the feeding cassette 4 located at the lowest position to the delivery tray 7. A front door (front opening mechanism, second openable portion) 11 has a center 101 at a lower portion of the apparatus front side to allow accessing to the conveyance route 25, and is openable along the conveyance route 25, which serves as a boundary. At that time, the secondary transfer roller 3 is exposed while being supported by the front door 11.

Figure 3:
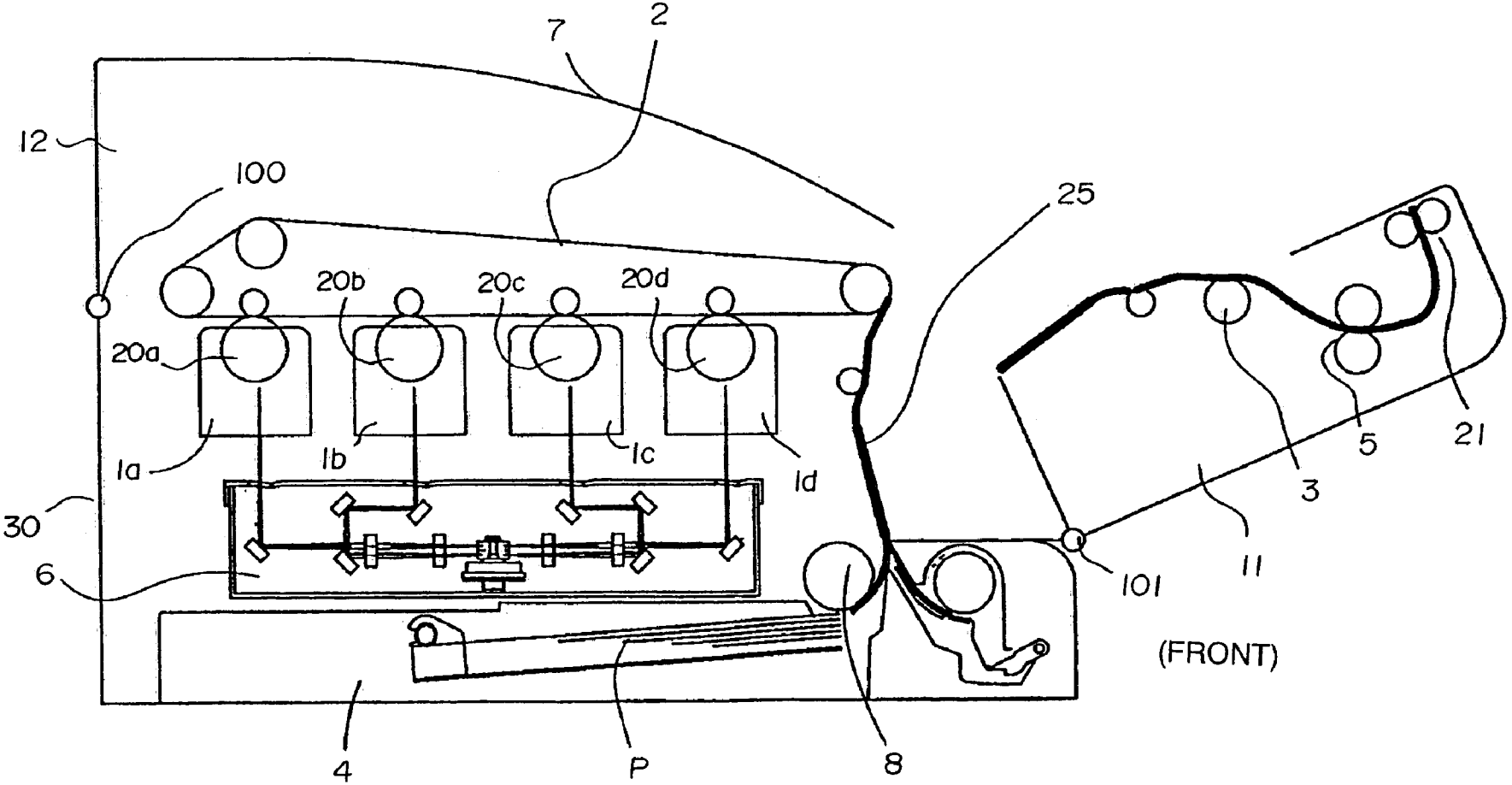
FIG. 3 is a cross-section showing a jamming recovery operation where a second openable portion is opened.

Manipulations during process cartridge replacement and paper jamming recovery are now described. FIG. 3 is a cross-section of the apparatus during a jamming recovery operation. In a case that jamming occurs during the operation of the image forming apparatus, the pressure of a spring or the like pushing the secondary transfer roller 3 to the intermediate transfer belt 2 is released, and then, the front door 11 is opened about the shaft 101 as a center located at the lower portion as shown in FIG. 3. After the front door 11, which is movable forward and backward with respect to the conveyance route 25, is thus moved toward the front side of the apparatus body 30, paper jamming recovery is performed at the conveyance route 25.

Figure 4:
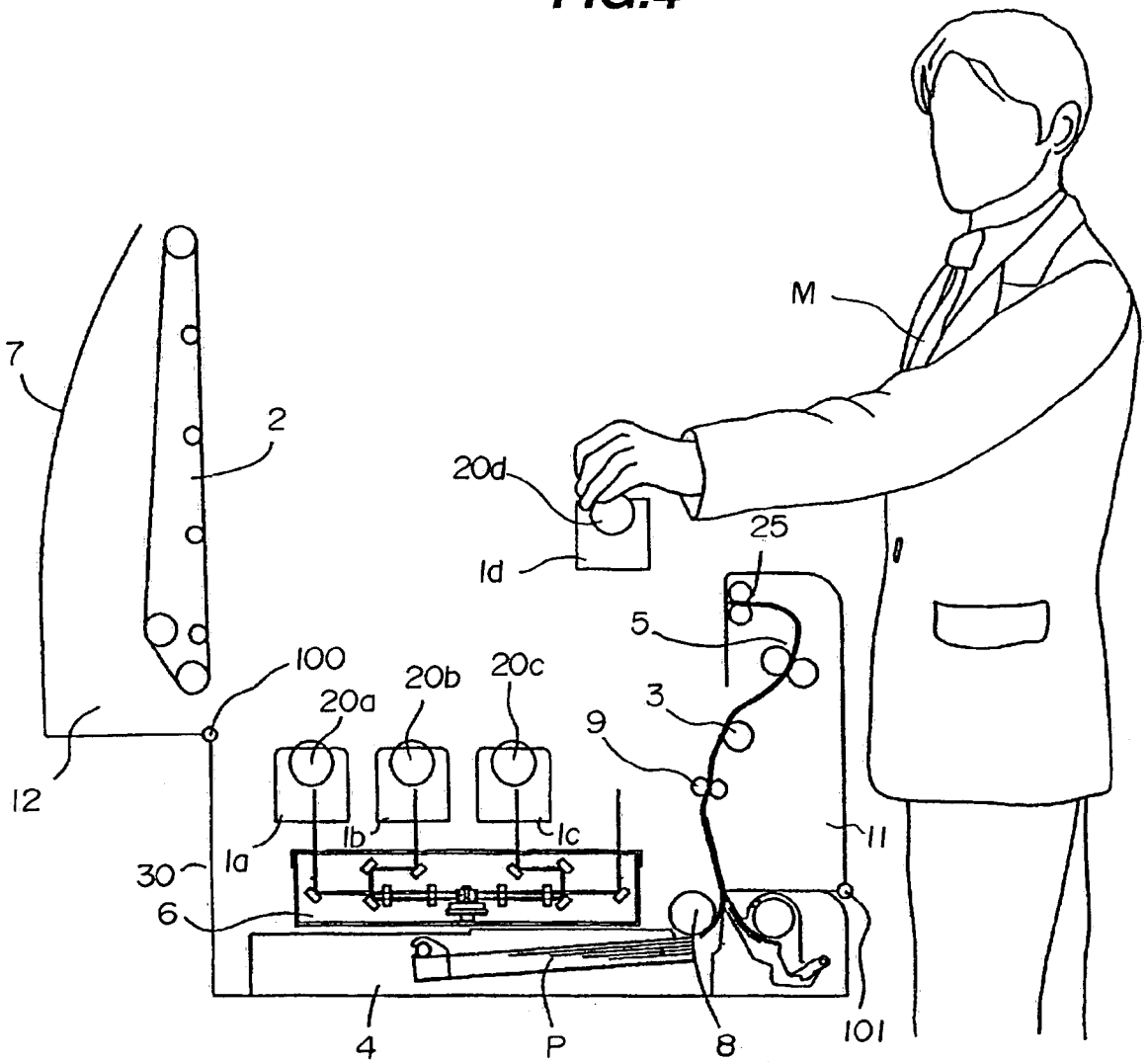
FIG. 4 is a cross-section showing a process cartridge replacement operation.

FIG. 4 is a cross-section of the apparatus during a process cartridge replacement operation. When the process cartridges 1*a* to 1*d* are to be replaced as maintenance work, an operator M upwardly opens the housing 12, which forms the delivery tray 7 and the transfer belt 2. For example, when the process cartridge id for black is to be replaced, after the process cartridge 1*d* is pulled out upwardly, a new one is attached. At that time, the front door 11, which can be opened for the jamming recovery, is not necessarily opened, so that the process cartridge 1 can be accessed easily. The process cartridge 1 can be inserted along a guide from an upper position when installing, so that no space is needed for forming a sliding mechanism for pulling out and inserting the process cartridge from a side surface of the apparatus body, and so that with a simpler structure, the apparatus can be made in a smaller size and the costs can be reduced.

Other Embodiments

Figure 5:
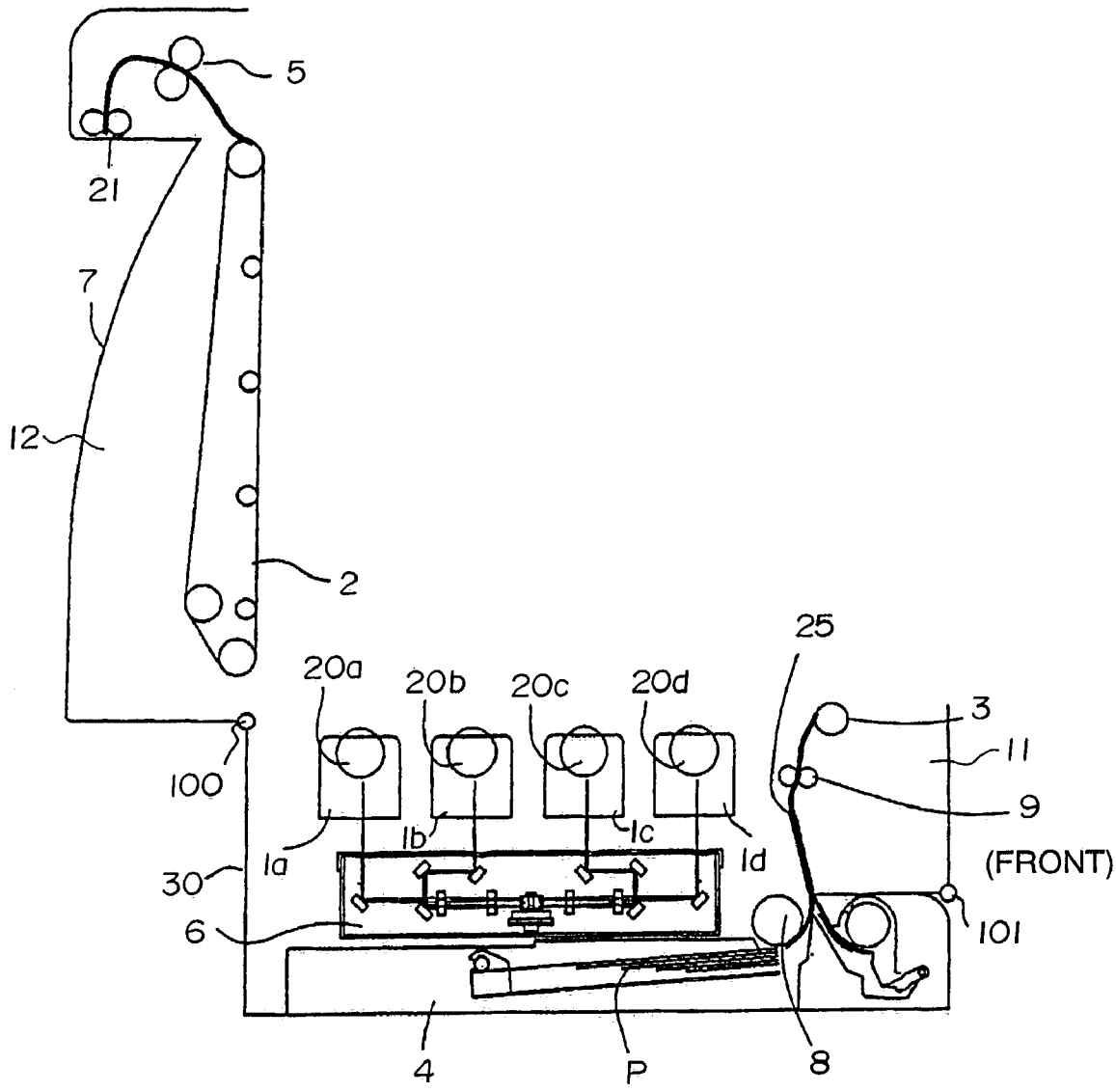
FIG. 5 is a cross-section illustrating an image forming apparatus of another embodiment.
Figure 6:
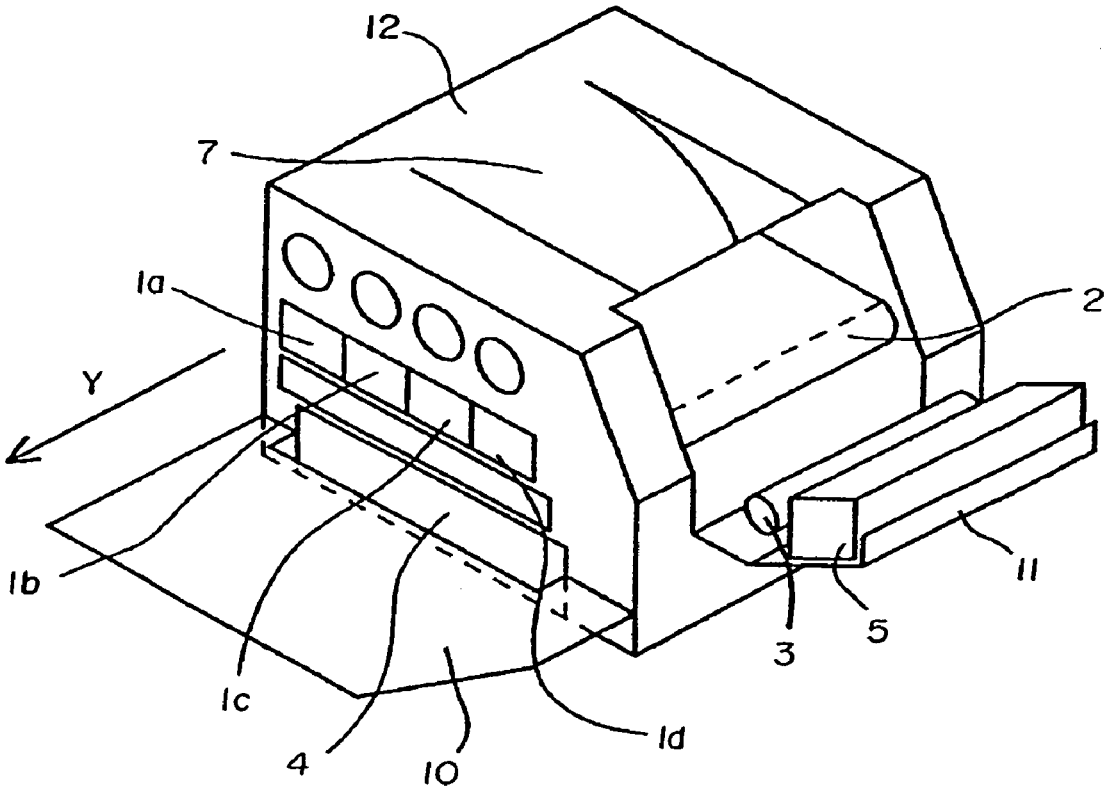
FIG.6 PRIOR ART
FIG. 6 is a perspective view showing a conventional image forming apparatus.
Figure 7:
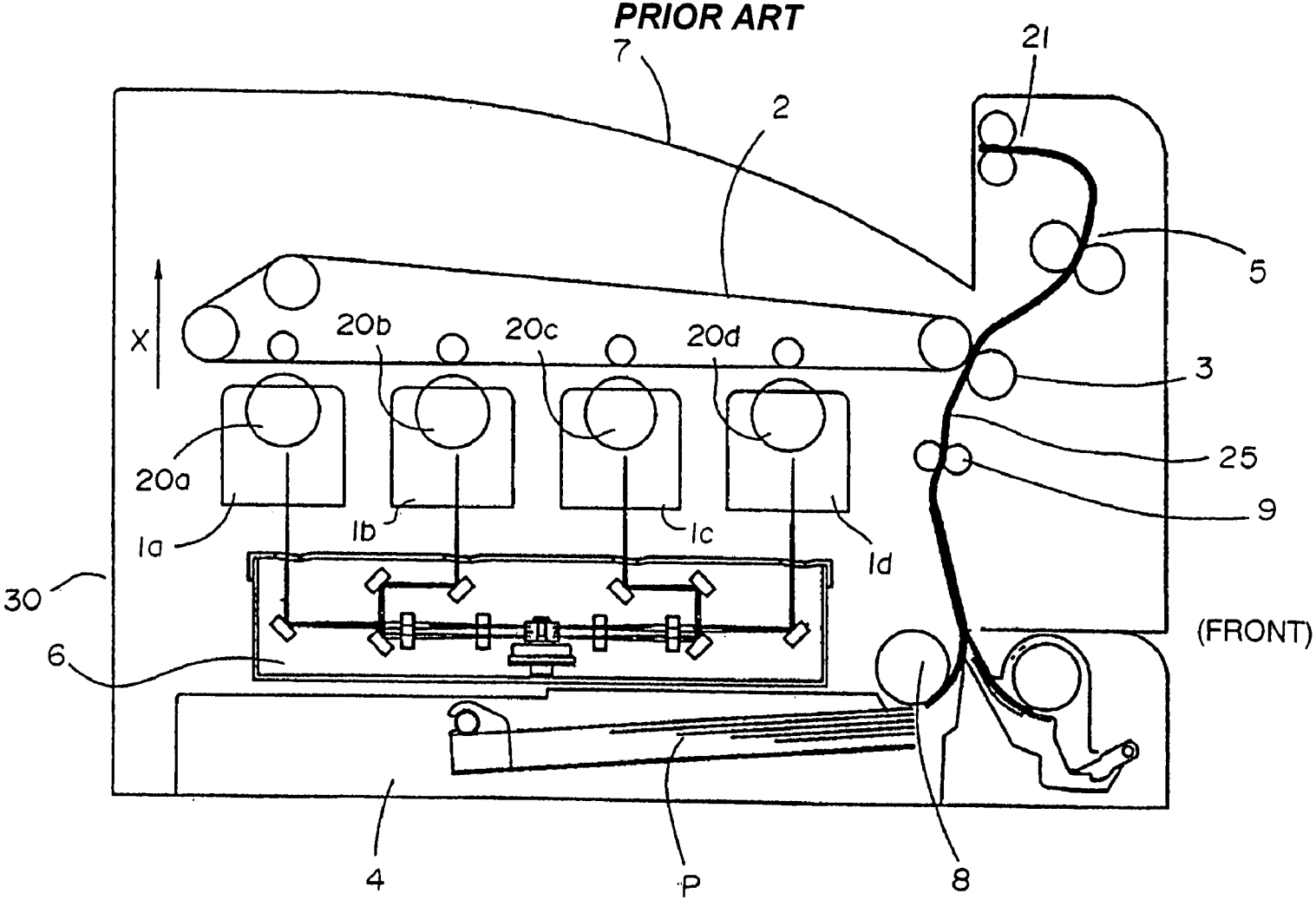
FIG.7 PRIOR ART
FIG. 7 is a cross-section showing the conventional image forming apparatus.

Although in the above embodiment the housing 12 is opened and closed with respect to the conveyance route 25 as a boundary and about the shaft 100 as a center to replace the process cartridges, the invention is not limited to this, and as shown in FIG. 5, the housing 12 can be structured to include not only the intermediate transfer belt 2 and the delivery tray 7, but also the fixing unit 5.

Although in the above embodiments, the image forming apparatus is described as a printer, the invention is not limited to this, and can be incorporated in other apparatuses, such as a facsimile machine or a photocopier.

What is claimed is:

1. An image forming apparatus comprising:

an image forming unit having an image bearing member and which is capable of being detachably attached to a main body of said image forming apparatus;

an intermediate transfer member disposed at an upper position relative to said image forming unit, and to which the image on said image bearing member is transferred;

recording material conveying means for conveying a recording material along a conveyance route;

a transfer member in contact with said intermediate transfer member for transferring the image on said intermediate transfer member onto the recording material conveyed by said recording material conveying means;

a fixing unit having a fixing member for fixing a toner image on the recording material and a pressing member for pressing said fixing member;

a first openable portion which is disposed on a side surface of the main body and is openable to expose the conveyance route, said first openable portion holding said transfer member; and a second openable portion which is disposed on an upper face of the main body, holds said intermediate transfer member, and is capable of being opened, separately from said fixing unit, for enabling insertion of said image forming unit into the main body in a state that said first openable portion is closed.

2. The image forming apparatus according to claim 1, wherein said first openable portion is openable around a first rotary shaft as a center, wherein said second openable portion is openable around a second rotary shaft as a center, and wherein the first rotary shaft and the second rotary shaft are disposed as to extend substantially parallel to a recording material conveyance surface and substantially perpendicular to a conveyance direction of the recording material.

3. The image forming apparatus according to claim 2, wherein the first rotary shaft and the second rotary shaft are disposed at positions such that said first openable portion and said second openable portion are moved away from each other when opened.

4. The image forming apparatus according to claim 1, wherein said intermediate transfer member and said second openable portion are structured in a united body.

5. The image forming apparatus according to claim 1, wherein said image forming unit is detachable in a vertical direction toward an installation side of said image forming apparatus.

6. The image forming apparatus according to claim 1, wherein said recording material conveying means comprises at least a pair of roller members, wherein one roller member is held by the main body, and wherein the other roller member is held by said first openable portion.

7. The image forming apparatus according to claim 1, wherein said fixing unit remains within the main body in a case that said second openable portion is opened with said first openable portion being closed.

8. The image forming apparatus according to claim 1, wherein said fixing unit is disposed above said transfer member and at a position not to interfere with said second openable portion in case of opening and closing of said second openable portion.

9. The image forming apparatus according to claim 1, wherein said fixing unit moves together with said first openable portion in case of opening said first openable portion.

* * * * *